US009552707B1

(12) United States Patent
Bala

(10) Patent No.: US 9,552,707 B1
(45) Date of Patent: Jan. 24, 2017

(54) WEARABLE DEVICE THAT INDICATES THE PASSAGE OF TIME AS A TACTILE SENSATION MOVING ACROSS THE SURFACE OF A PERSON'S SKIN

(71) Applicant: Shantanu Bala, Pearland, TX (US)

(72) Inventor: Shantanu Bala, Pearland, TX (US)

( * ) Notice: Subject to any disclaimer, the term of this patent is extended or adjusted under 35 U.S.C. 154(b) by 0 days.

(21) Appl. No.: 14/993,248

(22) Filed: Jan. 12, 2016

Related U.S. Application Data

(60) Provisional application No. 62/102,437, filed on Jan. 12, 2015.

(51) Int. Cl.
*G08B 6/00* (2006.01)
*G04C 21/00* (2006.01)
*G04G 13/00* (2006.01)

(52) U.S. Cl.
CPC ..... *G08B 6/00* (2013.01); *G04C 21/00* (2013.01); *G04G 13/00* (2013.01)

(58) Field of Classification Search
CPC ..... G04G 21/00; G04G 13/02; G04G 13/00; G04B 19/06; G04C 21/00; G08B 6/00
See application file for complete search history.

(56) References Cited

U.S. PATENT DOCUMENTS 5,559,761 A * 9/1996 Frenkel ..... G04G 21/06 368/187
5,686,882 A * 11/1997 Giani ..... G04G 13/028 340/407.1
6,081,949 A * 7/2000 Delicia ..... G04G 13/021 368/12
7,050,360 B2 * 5/2006 Saito ..... G04G 21/00 368/230
7,173,881 B1 * 2/2007 Freudenberg, Jr. ..... G04F 10/00 340/540
8,693,294 B1 * 4/2014 Tucker ..... G04C 21/16 368/250
2002/0012291 A1 * 1/2002 Robinett ..... G04G 13/02 368/73

OTHER PUBLICATIONS

Wire—dictionary.com—Jun. 12, 2016.*

* cited by examiner

*Primary Examiner* — Sean Kayes

(57) ABSTRACT

A wearable time-telling device that indicates the passage of time as a tactile sensation moving across the surface of the wearer's skin is disclosed. The wearable device does not require a person's vision in order to perceive the current clock time, and the device can even be discreetly used by a person who is blind or visually impaired.

8 Claims, 5 Drawing Sheets

WEARABLE DEVICE THAT INDICATES THE PASSAGE OF TIME AS A TACTILE SENSATION MOVING ACROSS THE SURFACE OF A PERSON'S SKIN

CLAIM OF BENEFIT TO PRIOR APPLICATION

This application claims benefit to U.S. Provisional Patent Application 62/102,437, entitled "A wrist strap that produces vibrotactile actuations to denote the passage of time to the wearer," filed Jan. 12, 2015. The U.S. Provisional Patent Application 62/102,437 is incorporated herein by reference.

BACKGROUND

Embodiments of the invention described in this specification relate generally to tactile stimuli and feedback devices, and more particularly, to a wearable time device that provides a tactile sensation indicating the passage of time.

To find out the time from a wrist watch, one typically needs to look down at the watch. An ordinary watch provides no unobtrusive indication of the passage of time without requiring the wearer to disrupt their visual attention. As a result, current time-telling devices require users to constantly check the time visually.

Existing wrist watches and cell phones provide us with information visually, but our sense of vision is frequently obstructed or needed to perform other tasks. A person may not be able to look at the time as displayed on a wrist watch, for example, when engaged in a sports activity, while driving a vehicle, or when doing anything that requires visual focus and attention. By doing so, the person would unnecessarily increase the likelihood of bad outcomes. Even if the person is able to divert his or her visual focus for only a short amount of time (e.g., a second or two to look down at a wrist watch), the resulting exposure to a bad outcome may be unjustifiably high. For instance, a vehicle collision or a big sports play can occur in an instant of time. Thus, unnecessary risk or loss of attentive engagement results when the person diverts visual attention to any existing wrist watch or wearable time device.

Therefore, what is needed is a way to provide temporal information through tactile stimuli that can be received by a person wearing a wearable device even when he or she is looking elsewhere or which can inform a person who is blind or visually impaired of the temporal information.

BRIEF DESCRIPTION

Some embodiments of the invention include a novel a wearable time-telling device that indicates passage of time as a tactile sensation moving across skin of a person wearing the device. The wearable time-telling device provides timing information through tactile stimuli that can be received by the person wearing the time-telling device even when the person is looking elsewhere. In some embodiments, the wearable time-telling device is a wearable time-telling wrist watch with a clock. The wearable time-telling wrist watch does not require a person's vision in order to perceive the current clock time, and the device can be used by a person who is blind or visually impaired.

In some embodiments, the wearable time-telling device indicates the passage of time in relation to a tempo of music beats. In these embodiments, the wearable time-telling device provides tactile sensation that is time-synchronized to match the tempo of the music beats. In this way, the wearable time-telling device acts as a metronome for music.

The preceding Summary is intended to serve as a brief introduction to some embodiments of the invention. It is not meant to be an introduction or overview of all inventive subject matter disclosed in this specification. The Detailed Description that follows and the Drawings that are referred to in the Detailed Description will further describe the embodiments described in the Summary as well as other embodiments. Accordingly, to understand all the embodiments described by this document, a full review of the Summary, Detailed Description, and Drawings is needed. Moreover, the claimed subject matters are not to be limited by the illustrative details in the Summary, Detailed Description, and Drawings, but rather are to be defined by the appended claims, because the claimed subject matter can be embodied in other specific forms without departing from the spirit of the subject matter.

BRIEF DESCRIPTION OF THE DRAWINGS

Having described the invention in general terms, reference is now made to the accompanying drawings, which are not necessarily drawn to scale, and wherein.

DETAILED DESCRIPTION

Figure 1:
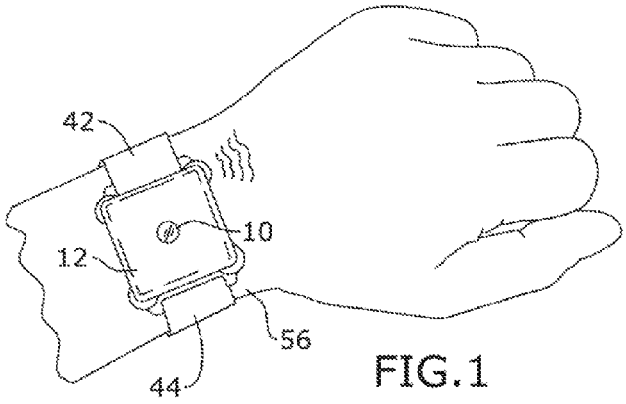
FIG. 1 conceptually illustrates a perspective view of a wearable time-telling device in some embodiments that indicates passage of time as a tactile sensation.

In the following detailed description of the invention, numerous details, examples, and embodiments of the invention are described. However, it will be clear and apparent to one skilled in the art that the invention is not limited to the embodiments set forth and that the invention can be adapted for any of several applications.

Some embodiments of the invention include a novel a wearable time-telling device that indicates passage of time as a tactile sensation moving across skin of a person wearing the device. The wearable time-telling device provides timing information through tactile stimuli that can be received by the person wearing the time-telling device even when the person is looking elsewhere. In some embodiments, the wearable time-telling device is a wearable time-telling wrist watch with a clock. The wearable time-telling wrist watch does not require a person's vision in order to perceive the current clock time, and the device can be used by a person who is blind or visually impaired.

In some embodiments, the wearable time-telling device indicates the passage of time in relation to a tempo of music beats. In these embodiments, the wearable time-telling device provides tactile sensation that is time-synchronized to match the tempo of the music beats. In this way, the wearable time-telling device acts as a metronome for music.

As stated above, to find out the time from a wrist watch, one typically needs to look down at the watch. An ordinary watch provides no unobtrusive indication of the passage of time without requiring the wearer to disrupt their visual attention. As a result, current time-telling devices require users to constantly check the time visually. Even when a person is able to divert visual attention to to wrist watch, there are numerous cases of even this being difficult or not possible. A person's sense of vision is frequently obstructed or cannot be diverted without assuming great risk or missing important input in performing other tasks. A person may not be able to look at the time as displayed on a wrist watch, for example, when engaged in a sports activity, while driving a vehicle, or when doing anything that requires visual focus and attention. By doing so, the person would unnecessarily increase the likelihood of bad outcomes. Even if the person is able to divert his or her visual focus for only a short amount of time (e.g., a second or two to look down at a wrist watch), the resulting exposure to a bad outcome may be unjustifiably high. For instance, a vehicle collision or a big sports play can occur in an instant of time. Thus, unnecessary risk or loss of attentive engagement results when the person diverts visual attention to any existing wrist watch or wearable time device Embodiments of the wearable time-telling device that indicates passage of time as a tactile sensation solve such problems by providing, to a person wearing the time-telling device, vibrotactile cues that indicate passage of time. In some embodiments, the wearable time-telling device is attached discreetly to a wrist strap at an inner side of the strap such that the vibrotactile cues are made along the person's skin, thereby indicating the passage of time as a sensation to be felt. The pattern and location of vibration changes according to the time of day, and the person wearing the device will have continuous knowledge of the current time from the tactile sensation.

Embodiments of the wearable time-telling device that indicates passage of time as a tactile sensation differ from and improve upon currently existing options. In particular, some embodiments of the wearable time-telling device differ because current wrist watches and cell phones provide temporal information visually. In contrast, the wearable time-telling device indicates passage of time as a tactile sensation along the skin of the person wearing the device. Thus, when a person's vision is obstructed or cannot be diverted, the wearable time-telling device provides the temporal information necessary to reveal passage of time (e.g., what time of the day it is, how much time has passed, etc.).

In addition, embodiments of the wearable time-telling device that indicates passage of time as a tactile sensation improve upon the currently existing options because current wrist watches and cell phones provide visual information, meaning that a person wearing the wrist watch needs to look at his or her wrist to check the time. However, a person's sense of vision is frequently obstructed or needed to perform other tasks, making is difficult to look down at a visual clock face. Ultimately, this disrupts the person's attention on a task and interrupts visual focus when the person needs to check the time. In contrast, the wearable time-telling device provides the time information through tactile stimuli that can be received by the person simply along the skin of the person. In this way, there is no need for the person to look away from a current visual attention point to check the time.

The wearable time-telling device of the present disclosure may be comprised of the following elements. This list of possible constituent elements is intended to be exemplary only and it is not intended that this list be used to limit the wearable time-telling device of the present application to just these elements. Persons having ordinary skill in the art relevant to the present disclosure may understand there to be equivalent elements that may be substituted within the present disclosure without changing the essential function or operation of the wearable time-telling device.

1. Vibration motors
2. Rechargeable lithium battery
3. Micro-controller with internal clock
4. Wrist band made from plastic elastomer
5. Insulated conductive thread
6. Hard plastic electronics enclosure
7. Adjustable clasp for wrist strap By way of example, FIGS. 1-4 conceptually illustrate several views of a wearable time-telling device that indicates passage of time as a tactile sensation. Specifically, FIG. 1 conceptually illustrates a perspective view of the wearable time-telling device that indicates passage of time as a tactile sensation. As shown, the wearable time-telling device includes an LED cover 10, a top shell 12, and a wrist band including an upper watch band 42 and a lower watch band 44. The wearable time-telling device shown here is wrapped on a person's wrist 56.

Figure 2:
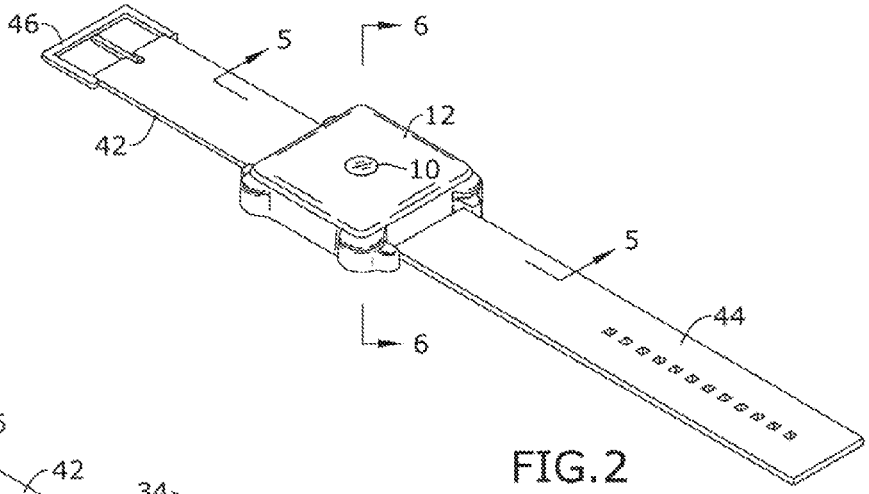
FIG. 2 conceptually illustrates a top perspective view of a wearable time-telling device in some embodiments that indicates passage of time as a tactile sensation FIG. 3 conceptually illustrates a bottom perspective view of a wearable time-telling device in some embodiments that indicates passage of time as a tactile sensation FIG. 4 conceptually illustrates an exploded view of the wearable time-telling device in some embodiments with wiring removed for clarity.

Turning to FIG. 2, which conceptually illustrates a top perspective view of the wearable time-telling device, an adjustable clasp 46 is attached to the end of the upper watch band 42. The adjustable clasp 46 allows the person wearing the wrist band to adjust its length to properly fit the size of the person's own wrist.

Figure 3:
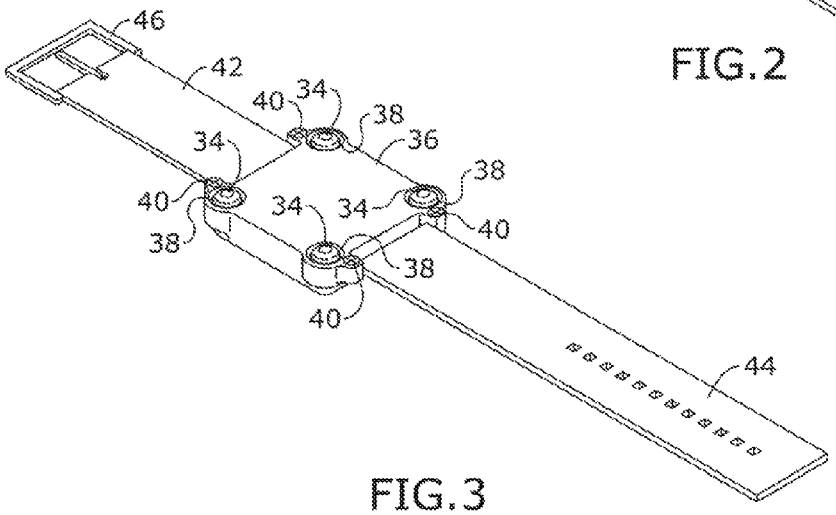

In FIG. 3, a bottom perspective view of the wearable time-telling device is shown. Several components are shown at the bottom, including a back plate 36, a plurality of motor extensions 34, a plurality of extension slots 38, and a plurality of screws 40.

Figure 4:
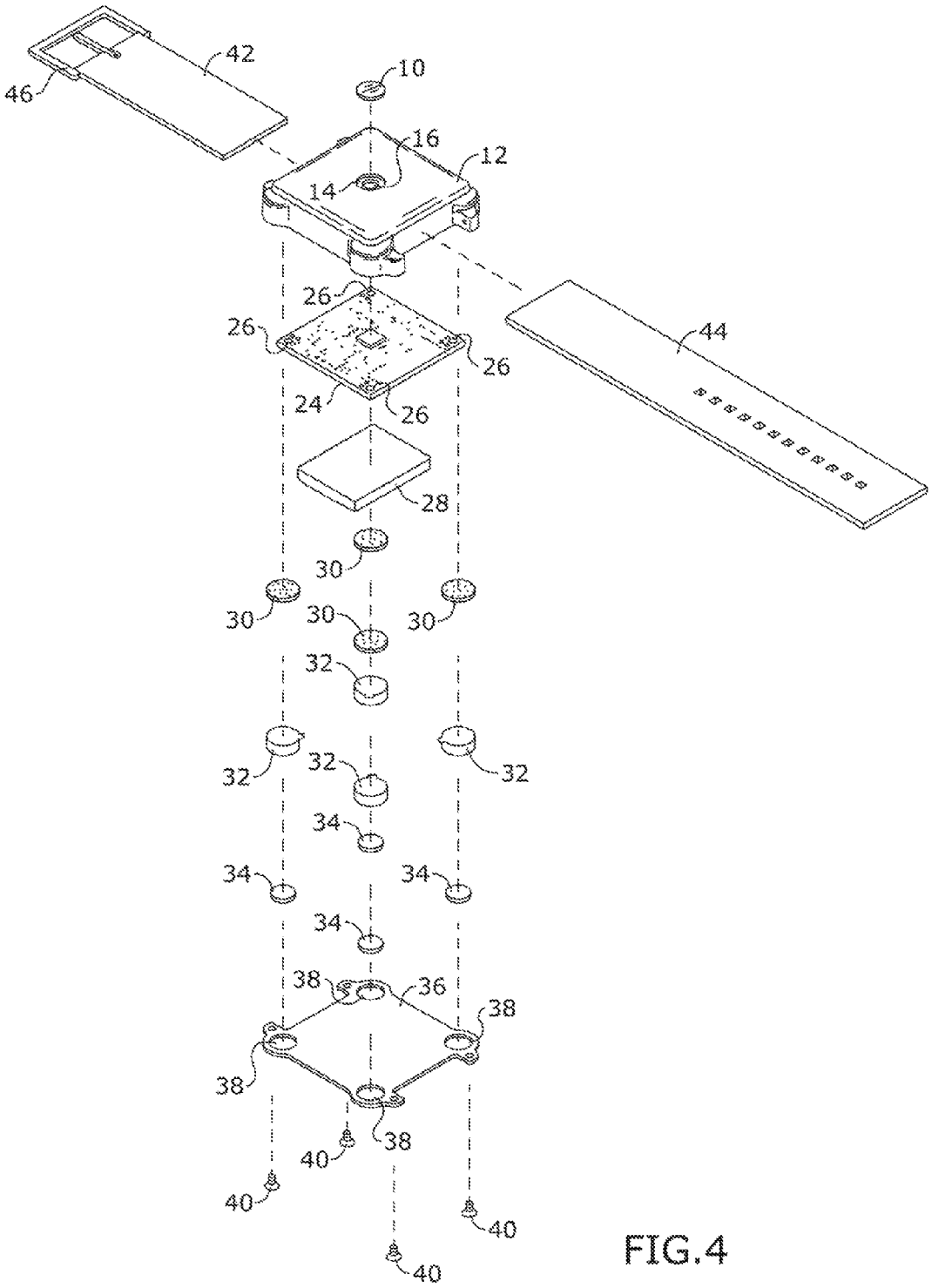

Now turning to FIG. 4, an exploded view of the wearable time-telling device is conceptually illustrated with wiring removed for clarity. In this figure, additional feature are shown, including an LED cover slot 14, an LED hole 16, a micro-controller 24, a plurality of micro-controller post slots 26, a battery 28, a plurality of pads 30, and a plurality of vibration motors 32. In some embodiments, the micro-controller 24 includes an internal clock with programmable interrupts that allows for the current time to be obtained and then provided to the connected vibration motors 32. In some embodiments, the plurality of vibration motors comprises four vibrations motors.

The wearable time-telling device of the present disclosure generally works by the vibration motors 32 producing a vibrotactile actuation perceivable on the surface of human skin, such as the skin of a person's wrist 56, using a linear resonant actuator powered by the battery 28. In some embodiments, the battery 28 is a rechargeable lithium battery 28 that allows it to be reused for several years. In some embodiments, the micro-controller 24 is programmed with single interrupt that checks the current time with a single millisecond resolution. After checking the current time, the micro-controller 24 programmatically switches on the vibration motors 32 to produce the tactile representation of the current time.

The intensity of each individual vibration motor is modulated with pulse width. Each individual motor on the wrist strap represents one of four primary numbers on a clock face: 12, 3, 6, and 9. To produce a sensation representing a particular position on the clock face, a pulse-width modulated vibration is produced with a duty cycle corresponding to the position of the clock hand relative to each motor. The wrist band (e.g., the upper watch band 42 and the lower watch band 44) allows the vibration motors 32 to make direct contact with the skin around the wrist 56 of the person using/wearing the device. The vibrations displayed on the wrist strap can provide varying levels of granularity (each denoted by a different total duration of vibration between 50 and 250 milliseconds) in units: days, hours, minutes, or seconds.

Figure 5:
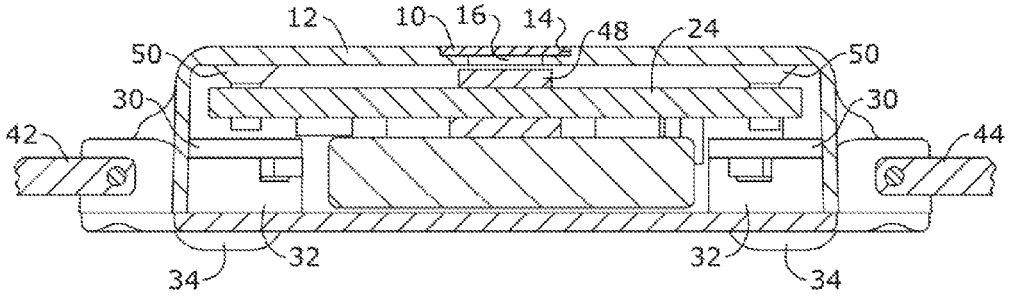
FIG. 5 conceptually illustrates a section view of the wearable time-telling device, taken along line 5-5 in FIG. 2, with wiring removed for clarity.
Figure 6:
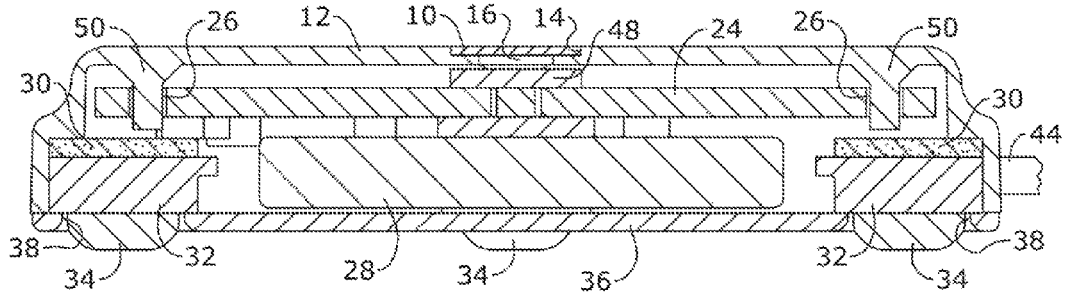
FIG. 6 conceptually illustrates a section view of the wearable time-telling device, taken along line 6-6 in FIG. 2, with wiring removed for clarity.

By way of example, FIGS. 5-6 conceptually illustrate section views of the wearable time-telling device with wiring removed for clarity. Specifically, FIG. 5 conceptually illustrates a section view of the wearable time-telling device taken along line 5-5 in FIG. 2, As shown in this figure, the LED cover slot 14 holds the LED cover 10 in the top shell 12. The LED hole 16 exposes light from an LED light 48 that is connected to the micro-controller 24. The top shell 12 provides a protective housing for the lithium battery 28 and micro-controller 24. In some embodiments, the top shell 12 is a hard plastic electronics enclosure. The micro-controller 24 is secured to the top shell 12 of the wearable time-telling device by a plurality of micro-controller retainer posts 50. Each of the pads 30 is positioned adjacent to a top side of one of the vibration motors 32 (between the micro-controller 24 and vibration motors 32), thereby protecting the micro-controller 24 from vibrations during vibrotactile actuation of the vibration motors 32. Each of the motor extensions 34 is positioned adjacent to an underside of the vibration motors 32 (between the skin of the person's wrist 56 and the vibration motors 32), thereby providing vibrations to the skin during vibrotactile actuation of the vibration motors 32.

Now turning to FIG. 6, a section view of the wearable time-telling device is conceptually illustrated along line 6-6 in FIG. 2. As shown in this figure, a plurality of micro-controller post slots 26 allow the micro-controller retainer posts 50 to secure the micro-controller 24 to the top shell 12. This leaves enough space for the LED light 48 to fit below the LED cover 10 in the LED cover slot 14 of the LED hole 16 of the top shell 12. The plurality of motor extensions 34 connect to the plurality of vibration motors 32 and fit through a plurality of extension slots 38. The pads 30 then protect the micro-controller 24 from vibrations of the vibration motors 32, with the pads only coming into contact with the micro-controller retainer posts 50, thereby preventing unstable vibrations to occur at one or more corners of the microcontroller 24. A back plate 36 covers the battery 28 within the wearable time-telling device.

Figure 7:
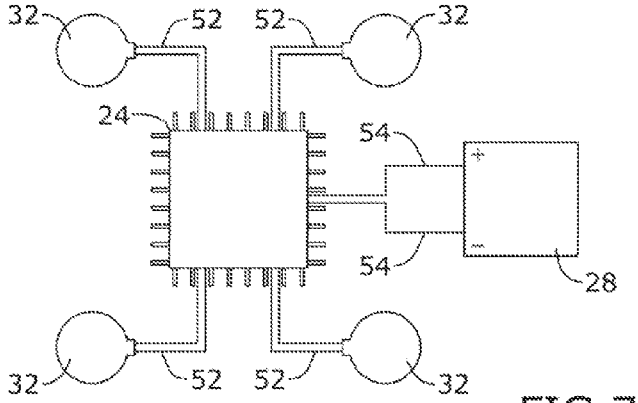
FIG. 7 conceptually illustrates a schematic view of wiring between a set of motors and a battery to a micro-controller of the wearable time-telling device in some embodiments.

FIG. 7 conceptually illustrates a schematic view of wiring between vibration motors 32, a battery 28, and a micro-controller 24 of the wearable time-telling device. As shown in this figure, connector wires 52 provide electrical connection between the vibration motors 32 and micro-controller 24. Battery connector wires 54 provide electrical connection between the lithium battery 28 and the micro-controller 24. The connector wires 52, the battery connector wires 54, or both may be insulated conductive thread.

To make the wearable time-telling device of the present disclosure, the micro-controller may be programmed with firmware that utilizes its internal clock and interrupts to keep the current time. The firmware may also include methods for driving the plurality of vibration motors (e.g., the four vibration motors presents in some embodiments) with pulse-width modulated signals.

The vibration motors and battery would be connected to the micro-controller using connections wires, such as insulated conductive thread. Each vibration motor connects to at least a single digital I/O pin capable of producing a pulse-width modulated signal. The appropriate power and ground terminals of the battery connect to the corresponding pins of the micro-controller. The ground connection for each vibration motor connects to the negative terminal of the battery.

The components of the device can be enclosed by the lid of the enclosure, which would snap shut. The micro-controller and battery are safer when placed inside of the enclosure, but different embodiments may allow for exposed portions. The enclosure may be made of plastic material. The plastic enclosure is optional, but provides protection for the electronics and reduces the risk of component failure. The material for the enclosure may vary—aluminum, ABS plastic, PLA plastic, polyethylene, polyolefin, and magnesium may all be used to provide protection for the electronics.

The wrist strap can be looped inside of a mechanical clasp on the side of the plastic electronics enclosure to securely fasten the enclosure onto the top of the strap. The wrist strap holds the electronic components around the wrist of a person wearing the device. In some embodiments, the upper and lower portions of the wrist strap include a specialized material. In some embodiments, the material is thermoplastic elastomer. In some embodiments, the material is a fabric. In some embodiments, the material is silicone. In some embodiments, the material is a textile material.

The adjustable clasp is affixed to the end of the wrist strap (by looping the strap through the clasp) to provide a quick mechanism through which the circumference of the strap may be adjusted easily by the person wearing the device. The adjustable clasp for the wrist strap may include different clasping mechanisms than those shown by the examples described above. Thus, although the examples above include a loop clasp, other embodiments of the wearable time-telling device use a different clasp mechanism to accomplish the same goal of providing adjustable lengths for the wrist strap. In still further embodiments, the adjustable clasp is not included. However, in these embodiments, the size of the wrist loop for the device is not adjustable.

The vibration motors, connection wires (or conductive thread), wrist strap, micro-controller, and battery are core components of the wearable time-telling device. The vibration motors produce the tactile sensation felt by the user. Although a linear resonant actuator (LRA) is used in many embodiments, in some other embodiments, an eccentric rotating mass (ERM) DC motor, solenoid actuator, or piezoelectric actuator may be used instead to produce a similar sensation for the wearer. Also, a larger or smaller number of vibration motors may be used (instead of four motors, one could imagine a wrist strap containing three or six motors).

The connecting wires, which is conductive thread in some embodiments of the device, carries electricity between several of the components. Although some embodiments of the wearable time-telling device use conductive thread for its flexibility, some other embodiments use insulated copper wire or flexible copper traces instead.

The micro-controller provides a clock and necessary digital logic to drive the vibration motors. This may be replaced with any roughly equivalent embedded circuit, but the replacement part must have the capability of keeping time and driving four vibration motors.

The battery provides electrical power for the device. A rechargeable lithium ion battery is used, but a variety of battery chemistry may be adopted to provide power. Alkaline, lithium polymer, or nickel-cadmium batteries may be used to provide power as well.

Figure 8:
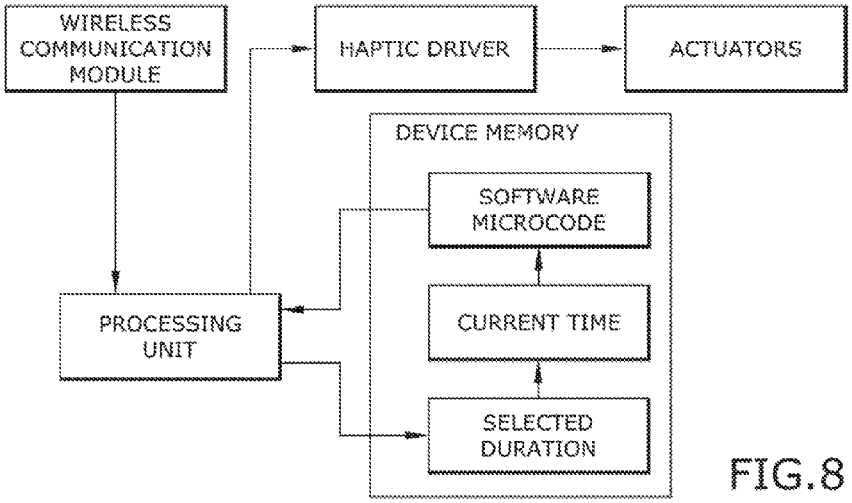
FIG. 8 conceptually illustrates a block diagram of the wearable time-telling device in some embodiments.

By way of example, FIG. 8 conceptually illustrates a block diagram of the wearable time-telling device in some embodiments. As shown in this figure, the wearable time-telling device of some embodiments includes a wireless communication module that retrieves current time data from a time-related information source.

To use the wearable time-telling device of the present disclosure, a person would wear the device around their wrist and adjust the wrist strap with the clasp to fit the size of their arm. As long as the vibration motors make direct contact with the skin, the wearer will feel a tactile sensation that travels around their wrist in a circle as time passes.

Figure 9:
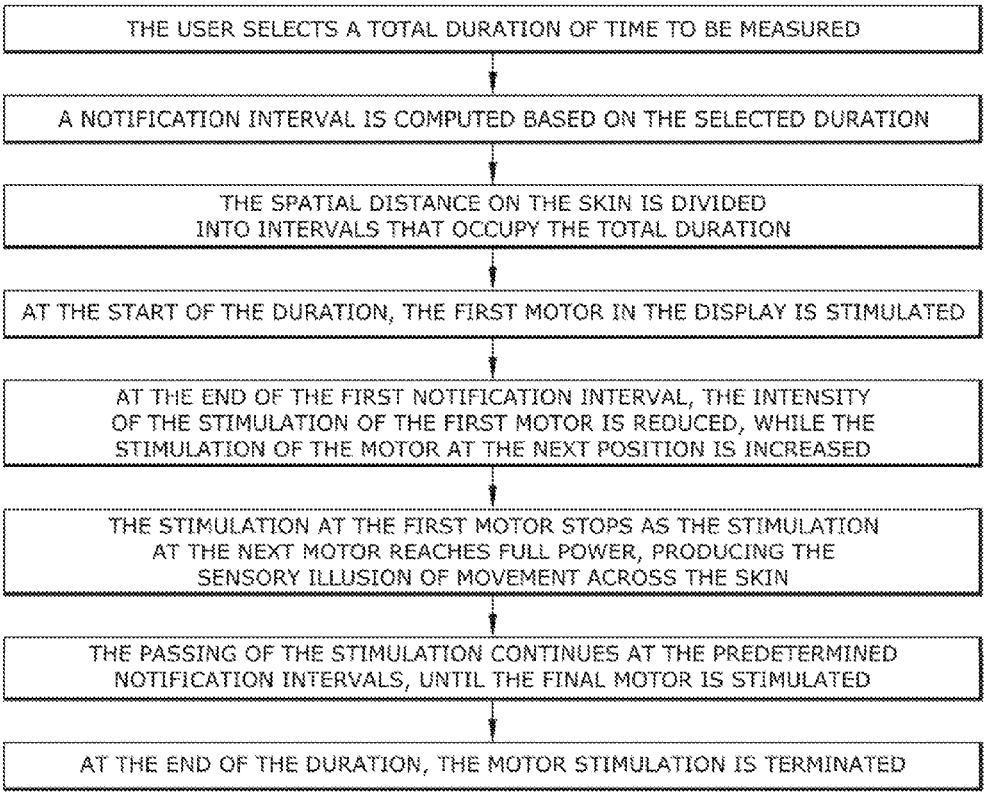
FIG. 9 conceptually illustrates a process for using the wearable time-telling device in some embodiments.

By way of example, FIG. 9 conceptually illustrates a process for using the wearable time-telling device. As shown in this figure, a person using the wearable time-telling device (the "user") selects a total duration of time to be measured. A notification interval is computed based on the selected duration. The spatial distance on the skin is then divided into intervals that occupy the total duration. At the start of the duration, a first motor in the display is triggered. At the end of the first interval, the intensity of the first motor is reduced while the next motor (second motor) is triggered. Intensity of the second motor increases as the intensity of the first motor decreases, thereby causing a sensation that time is moving in a predictable and consistent manner. Each of the motors is triggered in turn, and as needed, until the final motor (e.g., the fourth motor) is triggered. The cycle can repeat as needed. However, at the end of the duration, the motors stop vibrating.

While embodiments of the wearable time-telling device described above pertain to providing information about the passage of time, the tactile sensations on the wrist may be used to provide information about several other matters. Specifically, the wearable time-telling device of some embodiments indicates the passage of time in relation to a tempo of music beats. In these embodiments, the wearable time-telling device provides tactile sensation that is time-synchronized to match the tempo of the music beats. For example, the wearable time-telling device may provide a tactile vibration for every beat of music according to a time signature and tempo of the musical beats for the music. In this way, the wearable time-telling device acts as a metronome for music.

Other embodiments of the wearable time-telling device provide other information to the person wearing the device, including: the wearer's current location; email messages, text messages, and phone calls received on a cell phone; emotions or effect of another person; reminders of tasks a wearer must complete; navigation directions to reach a specific location; instruments or meters on the dashboard or display panel of an automobile or aircraft; download or upload progress of a digital file transfer; as well as alerts and notifications about the location of other people in close proximity to the wearer.

With a wireless Internet connection, the device may be used to connect to the Internet to provide real-time updates and alerts to a wearer from social media, electronic messaging systems, and web sites. With a connection to a cell phone, the device may be used to provide caller identification, message notifications, and battery life indicators. With a global positioning system, the device may be used to provide navigation instructions to the user or an awareness of his or her current location. With a connection to avionics and automotive instrumentation, the device can provide a pilot or driver with real-time alerts to prevent crashes. Further, the pilot or driver may receive information about velocity, acceleration, altitude, temperature, and atmospheric pressure entirely through vibrotactile feedback on their wrist.

Many of the above-described features and applications are implemented as software processes that are specified as a set of instructions recorded on a computer readable storage medium (also referred to as computer readable medium or machine readable medium). When these instructions are executed by one or more processing unit(s) (e.g., one or more processors, cores of processors, or other processing units), they cause the processing unit(s) to perform the actions indicated in the instructions. Examples of computer readable media include, but are not limited to, CD-ROMs, flash drives, RAM chips, hard drives, EPROMs, etc. The computer readable media does not include carrier waves and electronic signals passing wirelessly or over wired connections.

In this specification, the term "software" is meant to include firmware residing in read-only memory or applications stored in magnetic storage, which can be read into memory for processing by a processor. Also, in some embodiments, multiple software inventions can be implemented as sub-parts of a larger program while remaining distinct software inventions. In some embodiments, multiple software inventions can also be implemented as separate programs. Finally, any combination of separate programs that together implement a software invention described here is within the scope of the invention. In some embodiments, the software programs, when installed to operate on one or more electronic systems, define one or more specific machine implementations that execute and perform the operations of the software programs.

Figure 10:
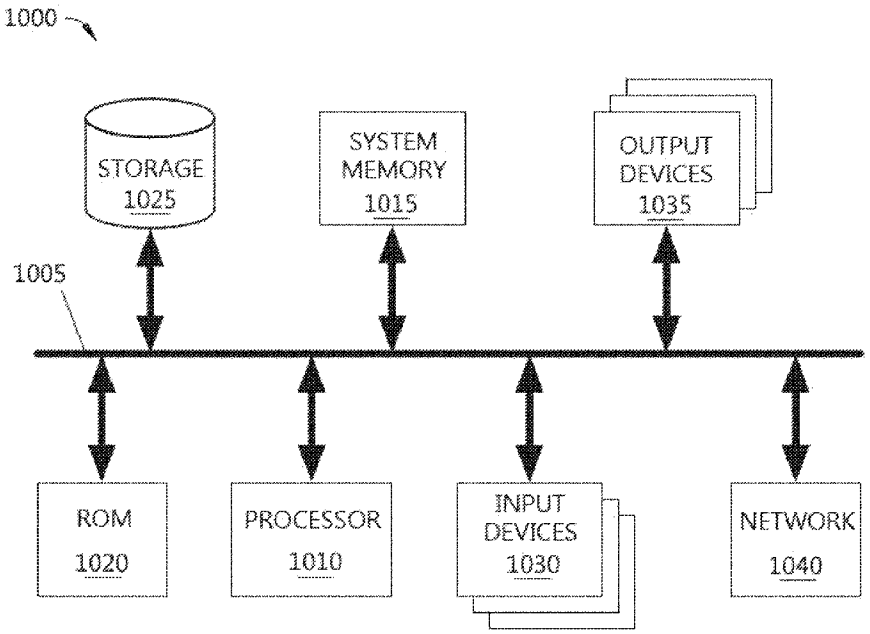
FIG. 10 conceptually illustrates an electronic system with which some embodiments of the invention are implemented.

FIG. 10 conceptually illustrates an electronic system 1000 with which some embodiments of the invention are implemented. The electronic system 1000 may be a computer, phone, PDA, or any other sort of electronic device. Such an electronic system includes various types of computer readable media and interfaces for various other types of computer readable media. Electronic system 1000 includes a bus 1005, processing unit(s) 1010, a system memory 1015, a read-only 1020, a permanent storage device 1025, input devices 1030, output devices 1035, and a network 1040.

The bus 1005 collectively represents all system, peripheral, and chipset buses that communicatively connect the numerous internal devices of the electronic system 1000. For instance, the bus 1005 communicatively connects the processing unit(s) 1010 with the read-only 1020, the system memory 1015, and the permanent storage device 1025.

From these various memory units, the processing unit(s) 1010 retrieves instructions to execute and data to process in order to execute the processes of the invention. The processing unit(s) may be a single processor or a multi-core processor in different embodiments.

The read-only-memory (ROM) 1020 stores static data and instructions that are needed by the processing unit(s) 1010 and other modules of the electronic system. The permanent storage device 1025, on the other hand, is a read-and-write memory device. This device is a non-volatile memory unit that stores instructions and data even when the electronic system 1000 is off. Some embodiments of the invention use a mass-storage device (such as a magnetic or optical disk and its corresponding disk drive) as the permanent storage device 1025.

Other embodiments use a removable storage device (such as a floppy disk or a flash drive) as the permanent storage device 1025. Like the permanent storage device 1025, the system memory 1015 is a read-and-write memory device. However, unlike storage device 1025, the system memory 1015 is a volatile read-and-write memory, such as a random access memory. The system memory 1015 stores some of the instructions and data that the processor needs at runtime. In some embodiments, the invention's processes are stored in the system memory 1015, the permanent storage device 1025, and/or the read-only 1020. For example, the various memory units include instructions for processing appearance alterations of displayable characters in accordance with some embodiments. From these various memory units, the processing unit(s) 1010 retrieves instructions to execute and data to process in order to execute the processes of some embodiments.

The bus 1005 also connects to the input and output devices 1030 and 1035. The input devices enable the member to communicate information and select commands to the electronic system. The input devices 1030 include alphanumeric keyboards and pointing devices (also called "cursor control devices"). The output devices 1035 display images generated by the electronic system 1000. The output devices 1035 include printers and display devices, such as cathode ray tubes (CRT) or liquid crystal displays (LCD). Some embodiments include devices such as a touchscreen that functions as both input and output devices.

Finally, as shown in FIG. 10, bus 1005 also couples electronic system 1000 to a network 1040 through a network adapter (not shown). In this manner, the computer can be a part of a network of computers (such as a local area network ("LAN"), a wide area network ("WAN"), or an intranet), or a network of networks (such as the Internet). Any or all components of electronic system 1000 may be used in conjunction with the invention.

These functions described above can be implemented in digital electronic circuitry, in computer software, firmware or hardware. The techniques can be implemented using one or more computer program products. Programmable processors and computers can be packaged or included in mobile devices. The processes may be performed by one or more programmable processors and by one or more set of programmable logic circuitry. General and special purpose computing and storage devices can be interconnected through communication networks.

Some embodiments include electronic components, such as microprocessors, storage and memory that store computer program instructions in a machine-readable or computer-readable medium (alternatively referred to as computer-readable storage media, machine-readable media, or machine-readable storage media). Some examples of such computer-readable media include RAM, ROM, read-only compact discs (CD-ROM), recordable compact discs (CD-R), rewritable compact discs (CD-RW), read-only digital versatile discs (e.g., DVD-ROM, dual-layer DVD-ROM), a variety of recordable/rewritable DVDs (e.g., DVD-RAM, DVD-RW, DVD+RW, etc.), flash memory (e.g., SD cards, mini-SD cards, micro-SD cards, etc.), magnetic and/or solid state hard drives, read-only and recordable Blu-Ray® discs, ultra density optical discs, any other optical or magnetic media, and floppy disks. The computer-readable media may store a computer program that is executable by at least one processing unit and includes sets of instructions for performing various operations. Examples of computer programs or computer code include machine code, such as is produced by a compiler, and files including higher-level code that are executed by a computer, an electronic component, or a microprocessor using an interpreter.

While the invention has been described with reference to numerous specific details, one of ordinary skill in the art will recognize that the invention can be embodied in other specific forms without departing from the spirit of the invention. For instance, FIG. 9 conceptually illustrates a process in which the specific operations of the process may not be performed in the exact order shown and described. Specific operations may not be performed in one continuous series of operations, and different specific operations may be performed in different embodiments. Furthermore, the process could be implemented using several sub-processes, or as part of a larger macro process. Thus, one of ordinary skill in the art would understand that the invention is not to be limited by the foregoing illustrative details, but rather is to be defined by the appended claims.

I claim:

1. A wearable time-telling device that indicates passage of time as a tactile sensation moving across the skin of a person wearing the device, said device comprising:

a battery that provides power to electrical components of the wearable time-telling device;

a plurality of vibration motors that vibrate along the skin of the person to produce the tactile sensation perceptible to the person;

a micro-controller comprising an internal clock and firmware that keeps track of time and triggers interrupts that signal one or more of the vibration motors to actuate and produce vibrotactile sensations;

a wrist strap that wraps around a wrist of the person and secures the battery, the vibration motors, and the micro-controller together around the wrist of the person; and a plurality of connection wires that distribute electricity from the battery to the micro-controller and the plurality of vibration motors; wherein the plurality of vibration motors comprise four motors; the four vibration motors comprise a first vibration motor that represents a first clock face number, a second vibration motor that represents a second clock face number, a third vibration motor that represents a third clock face number, and a fourth vibration motor that represents a fourth clock face number.

2. The wearable time-telling device of claim 1, wherein the plurality of connection wires comprises conductive thread.

3. The wearable time-telling device of claim 1, wherein the battery is a rechargeable lithium battery.

4. The wearable time-telling device of claim 1, wherein the firmware of the micro-controller programmatically checks a current time property of the internal clock at least one time every millisecond.

5. The wearable time-telling device of claim 4, wherein the firmware of the micro-controller programmatically triggers interrupts at least one time every millisecond.

6. The wearable time-telling device of claim 1, wherein the firmware of the micro-controller programmatically determines a vibration intensity level along a vibration intensity range at which to vibrate each vibration motor.

7. The wearable time-telling device of claim 1, wherein a sensation representing a particular position on the clock face is produced by a pulse-width modulated vibration that is produced with a duty cycle corresponding to a position of the clock hand relative to each vibration motor.

8. The wearable time-telling device of claim 1 further comprising an LED lighted screen that displays a visual representation of the time on the screen while vibrotactile sensation is provided to the skin of the person.

* * * * *